US005174683A

United States Patent [19]

Grandori

[11] Patent Number: 5,174,683

[45] Date of Patent: Dec. 29, 1992

[54] TELESCOPIC DOUBLE SHIELD BORING MACHINE

[76] Inventor: Carlo Grandori, No. 93, Viale America, 00144 Roma, Italy

[21] Appl. No.: 673,638

[22] Filed: Mar. 22, 1991

[30] Foreign Application Priority Data

Apr. 2, 1990 [IT] Italy ..... 47823 A/90

[51] Int. Cl.[5] ..... E21D 9/00

[52] U.S. Cl. ..... 405/145; 299/33; 405/138; 405/141

[58] Field of Search ..... 405/144, 142, 143, 145; 299/31, 33

[56] References Cited

U.S. PATENT DOCUMENTS

| | | | |
|---|---|---|---|
| 3,350,889 | 11/1967 | Sturm | 405/143 |
| 4,122,683 | 10/1978 | Follert et al. | 405/142 |
| 4,398,845 | 8/1983 | Stuckmann et al. | 405/145 |
| 4,508,390 | 4/1985 | Bessac | 405/143 X |

*Primary Examiner*—Dennis L. Taylor

*Attorney, Agent, or Firm*—Samuels, Gauthier & Stevens

[57] ABSTRACT

The invention relates to a boring machine for digging tunnels in a wide variety of qualities of ground, of the type comprising a first front shield, containing the boring head, and the members for driving the same, and a second shield, fitted with posts or "grippers" for providing the anchorage necessary for the advancement of the boring machine, in which a third shield is provided, arranged between said first and said second shield, such that the first shield overlaps partly with it and is able to slide axially with respect to the third shield itself and that the assembly first shield/third shield is able to vary its advancing direction with respect to the second shield; guide means being provided between said first and said third shield, which guide means allow these latter to perform a relative movement in the longitudinal axial direction only, and means being provided for advancing said first shield with respect to said third sh shield, as well as means for setting at an angle the assembly first shield/third shield with respect to said second shield.

15 Claims, 2 Drawing Sheets

TELESCOPIC DOUBLE SHIELD BORING MACHINE

The present invention relates to a telescopic double shield boring machine, and more particularly it relates to a boring machine of the said type, in which the structure of the telescopy between the two shields has been modified, so as to avoid the drawbacks that are typical of such a type of boring machine.

As is known, the telescopic double shield boring machines of a first generation comprised a first shield, arranged at their front end, and bearing the boring head, and the members that cause the latter to rotate, and a second shield, which is partially telescopic with respect to the first, where the so called pads or "grippers" for providing the anchorage necessary for advancing the boring machine are installed.

The thrust cylinders are arranged between the two shields.

This type of boring machine has been conceived to work in various qualities of hard, cracked, unstable rock, in incoherent grounds and/or in the presence of water, allowing a means for supporting or for lining the ground to be realized, if necessary, according to the technology of the shield, at the same time of the excavation.

However, though they are a noticeable improvement with respect to the previously employed boring machines, they have some shortcomings.

Indeed, when one works in rocks that under the action of the boring machine produce a lot of sand, in weak, alluvial, unstable or bonding grounds, such as clays, also as a function of the water that comes from the ground itself, some drawbacks arise, particularly at the digging head and/or at the telescopic zone.

The drawbacks concerning the head have been partly solved by adopting blindages of the same, rotating gratings, buckets having a protected and/or variable opening.

The problems concerning the telescopic zone arise from the need for guiding and/or operating in curves. The guide system is based on the variation of the the cylinders that operate the thrust. For instance: if one wants to go to the right, one thrusts more on the left cylinders, and vice-versa if one wants to go to the left.

The telescopic zone is realized by coupling two cylindrical zones, the one at the interior of the other, integral to the first and to the second shield, respectively.

When the front shield is steered for guide reasons, so as to be advanced accomplishing an angle with respect to the rear shield, which is stationary and locked by the grippers, the telescopic zone is subject to shearing and bending stresses that arise between the inner and the outer shield, increasingly with the withdrawal of the telescopic zone and the smaller is the clearance between the two shields.

Consequently, the telescopic zone gets deformed after a working period and the two cylinders take a substantially cone frustum shape.

Owing to this deformation, the loose and unstable materials penetrate between the two cylinders, causing the jamming of the telescopic shields and the resulting blocking of the boring machine.

The installation of seals isn't possible, owing to the irregularity and to the variability of the size of the shields with time.

A joint between the inner telescopic shield and the rear shield has been realized in other exemplars, by connecting the two members with a series of longitudinal cylinders that afford the possibility to form angles between the inner telescopic shield and the rear shield. Even with this provision, the phenomenon of the deformation of the telescopic shields happens all the same, as situations always arise of an angle between the two members of the telescopy bigger than that allowed by the clearance between the parts of the same.

In view of this problem, the Applicant has designed a structural modification to the double shield boring machines, by which deformations of the telescopic zone of the boring machine are prevented from arising. The clearance between the two telescopic shields can be reduced to a minimum and it is possible to install gaskets and/or members for cleaning the annular gap, thereby reducing the mentioned infiltrations and avoiding the risk of the blocking of the telescopic shields and, consequently, of the boring machine.

These and other results are obtained, according to the present invention, by proposing a boring machine in which the portions that make up the telescopic zone are forced to slide rigidly and parallelly with respect to each other by suitable guides, keeping concentric to a common longitudinal axis, such that there is no reciprocal transmission of stresses or forces, which are taken by the guides, excluding the friction of gaskets and the like.

It is therefore the specific subject of the present invention a boring machine for digging tunnels in a wide variety of grounds, of the kind comprising a first, front shield, which contains the boring head and its driving members, and a second shield, fitted with pads "grippers" for providing the anchorage necessary for advancing the boring machine, in which a third shield is provided arranged between said first and said second shield, such that the first shield overlaps partly to it and is able to slide axially to the third shield itself and the assembly of the first shield and the third shield is able to vary its advancing direction with respect to the second shield; guiding means being provided between said first shield and said third shield, that allow the same to reciprocally move only in the longitudinal axial direction, while keeping concentric, and that prevent the same from relatively rotating about the longitudinal axis, and means being provided for advancing said first shield with respect to said third shield, as well as means for setting the assembly of the first shield and of the third shield at an angle with respect to said second shield.

In particular, said guide means between said first and said third shield can be comprised of a preferably tubular, longitudinal axial central structure, integral with the first shield, sliding within a guide arranged on said third shield.

The coupling between the central structure and the guide can extend longitudinally so as to support radial, twisting and bending loads, thereby keeping said first and third shield strictly parallel.

Still according to the present invention, said coupling between the central structure and the guide can be longitudinally extended so as to support radial loads and twisting and bending moments, further guide means being provided, in this instance, preferably comprised of beams peripherally supported by said first shield and by corresponding peripheral guides supported by the third shield.

The partial overlap between the first and the third shield can be realized in proximity of the zone of the coupling between the second and the third shield or in an opposite position with respect to said zone.

The means for advancing the first shield with respect to the third shield can be comprised of first parallel fed hydraulic cylinders, identical arranged between the first and the third shield, while the means for setting the assembly of the first shield and of the third shield at an angle to the second shield can be comprised of second variable flow hydraulic cylinders arranged between the second and the third shield.

In another embodiment according to the present invention, said first hydraulic cylinders identical arranged between the first and the second shield, are variable flow hydraulic cylinders, and can act as both an advancing means and a steering means.

Third hydraulic cylinders, tangential in the plane perpendicular to the longitudinal axis of the shields, will be also provided between the second and the third shield to control the relative rotational angle between the second and the third shield.

The outer portion of the first shield and/or the outer portion of the third shield can be comprised of demountable sectors, so as to allow the same to be replaced in a tunnel.

Seal members and/or members for cleaning the telescopic zone between the first and the third shield can be also provided among the parts that make up the boring machine according to the present invention, having met the requirement of realizing a relative motion strictly parallel between the first and the third shield, and to transmit torque reaction forces to the gripper via a second shield structure.

The present invention will be now disclosed according to its preferred embodiments, with particular reference to the figures of the annexed drawings, in which.

Figure 1:
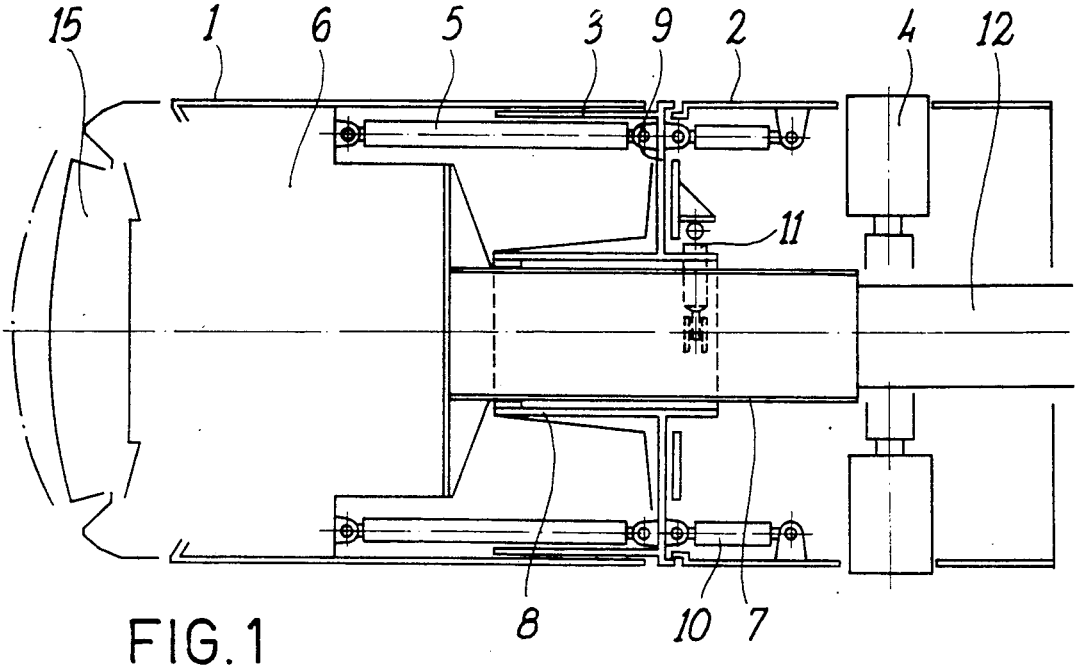
FIG. 1 is a schematic top view of a first embodiment of the boring machine improved according to the present invention.

The boring machine of FIG. 1 comprises a first shield 1, upon which the cutting head and its rotation members (not shown) are arranged, a second shield 2, upon which the "grippers" 4 are provided.

A third shield 3 is arranged between the two shields 1 and 2, which has its front portion inserted into the interior of the shield 1 and has a rear portion so shaped, as to mate, outerly, with the front shaped zone of the shield 2.

The cylinders 5 that operate the thrust of the head (not shown) are arranged between the support 6 of the head itself, integral with the shield 1, and the shield 3 and are fed in parallel.

The support 6 integral with the shield 1 and connected to a tubular axial structure 7, within which the transporting means (12) of the digging product flows.

Said tubular structure 7 slides at the interior of a guide 8 integral with the shield 3.

The coupling between the tubular structure 7, integral with the shield (1) and the guide 8 is such as to oblige the shield 1 to advance only longitudinally with respect to the shield 3, keeping always parallel and concentric to it, and preventing relative rotations of the two shields about the longitudinal axis from occurring.

The bending, shearing and twisting stresses coming from the support of the head are taken by the structure (7) and transmitted to the guides (8); from these to the transverse structure (9) which is integral with the shield 3.

The angular variations of the axis of the boring machine, that is to say of the assembly of the shield 1 and of the shield 3 with respect to the shield 2 are achieved by means of auxiliary cylinders 10, that connect the shield 3 with the shield 2 which, being locked by the "grippers" 4, provides the reactions necessary for the cylinders 10 and 5.

By changing the throughput flowing into the cylinders 10, one changes the direction of advancement.

A pair of cylinders (only one of them can be seen in the figures) 11 is arranged between the shields 2 and 3, which cylinders are arranged tangentially in the plane perpendicular to the axis of the shields 1, 2 and 3, and transmit the twisting coming from the torque that acts on the head, from the shield 3 to the shield 2, through guides 8 and structure 9.

In this solution, the telescopic zone between the shield 1 and the shield 3 is realized in the proximity of the mating zone between the shield 3 and the shield 2.

Figure 2:
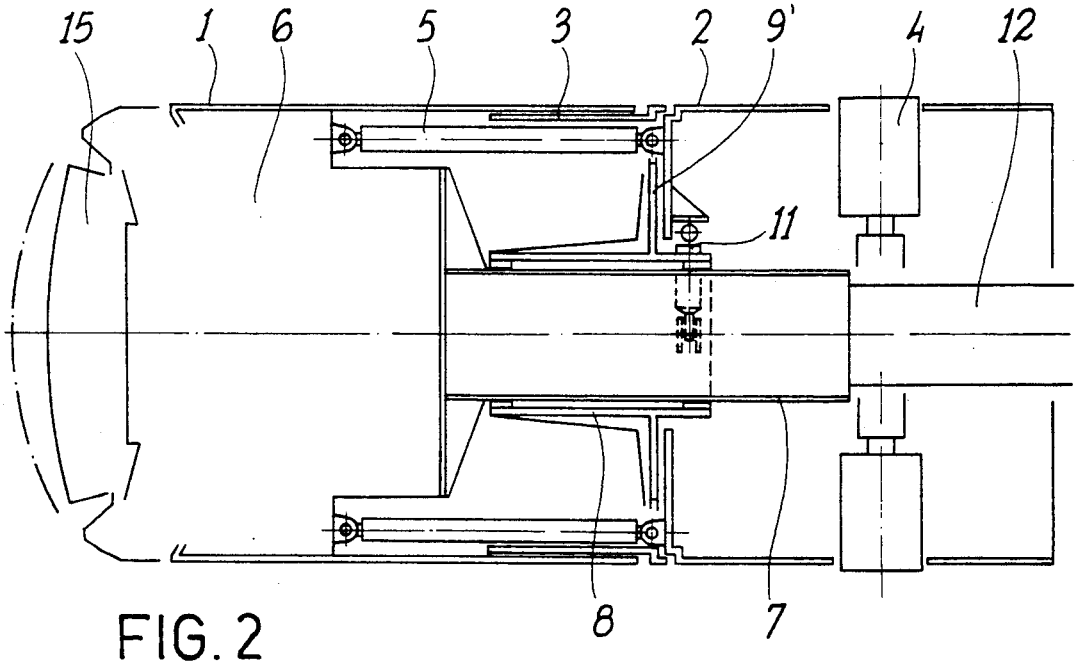
FIG. 2 is a schematic top view of a second embodiment of the boring machine improved according to the present invention.

The embodiment of FIG. 2, in which the elements corresponding to those of FIG. 1 are indicated with like reference numbers, has a structure 9' having such openings as to allow the cylinders 5 to operate between the support 6 of the head and the shield 2.

In this instance, therefore, the cylinders 5 determine the advancement of the shield 1 with respect to the shield 3 and, by varying the oil throughput, also the variations of the direction of advancement of the axially rigid structure comprised of the shield 1 and of the shield 3, axially rigid through the guides (7 and 8), guide 8 being fitted with suitable means to prevent shield 3' from being dragged forward by friction.

Figure 3:
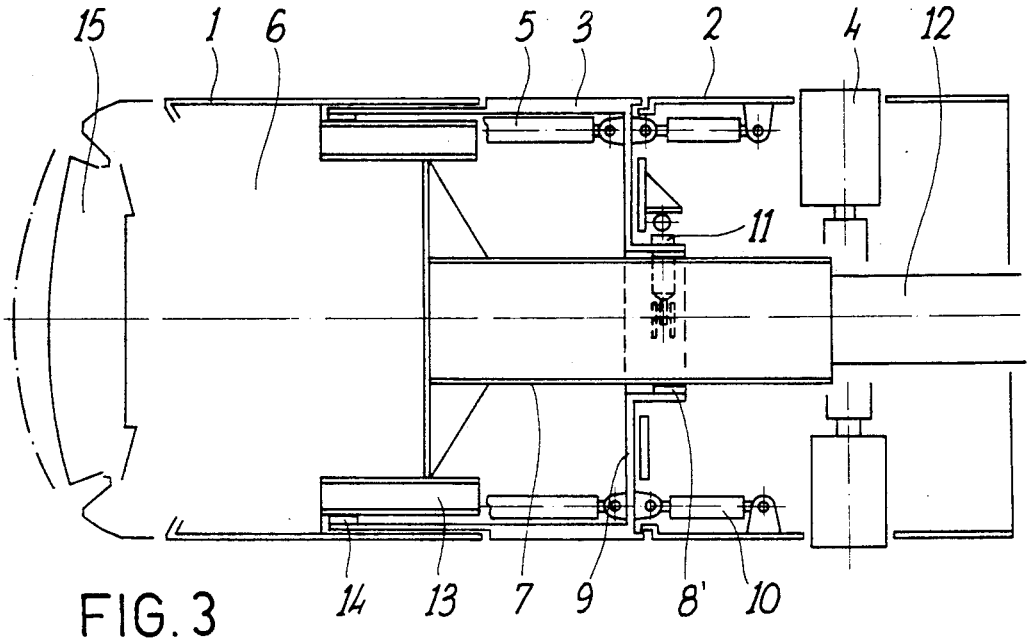
FIG. 3 is a schematic top view of a third embodiment of the boring machine improved according to the present invention.

Also the solution represented in FIG. 3 provides three shields 1, 2 and 3.

In this instance, the telescopic overlap zone between the shield 1 and the shield 3 is realized at a greater distance with respect to the coupling zone between the shield 2 and the shield 3.

The guides that control the relative motions of the shields 1 and 3 are made up of a tubular structure 7, substantially like that shown with reference to FIGS. 1 and 2, that slides within the guide 8', integral with the structure 9, that extends longitudinally about the tubular structure 7 to a lesser extent than the guide 8 of the preceding embodiments.

In this instance, moreover, a side structure is provided, between the shield 1 and the shield 3, comprised of side beams 13, sliding within side guides 14, that, together with the guide 8', obliges the shields 1 and 3 to coaxially slide and supports the relevant stresses.

Also in this case the advancing cylinders 5 are provided, as well as the steering cylinders 10 and the torque cylinders 11.

Figure 4:
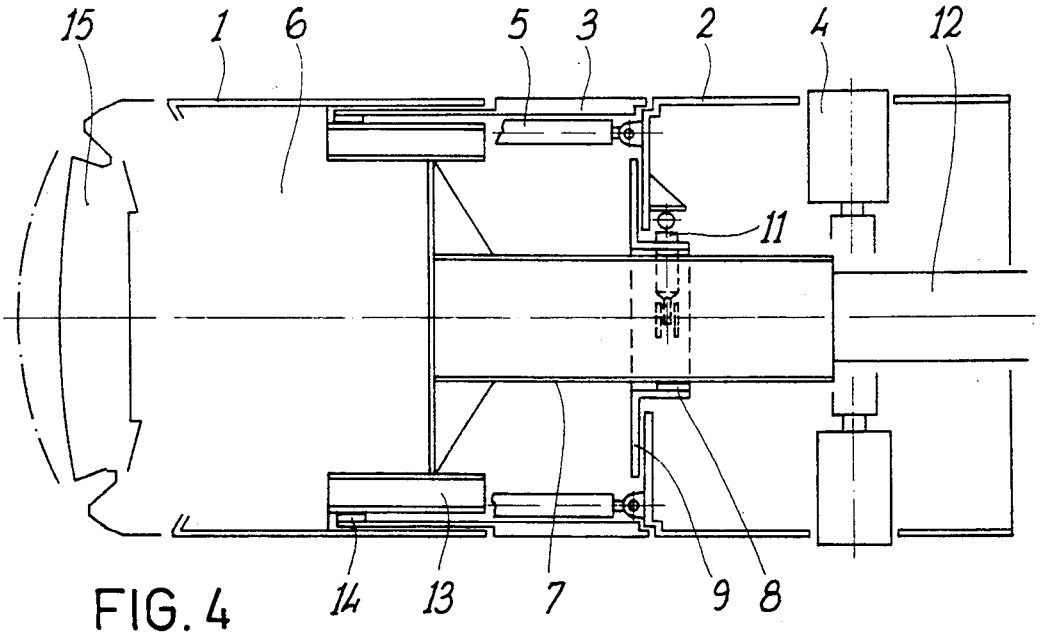
FIG. 4 is a schematic top view of a fourth embodiment of the boring machine improved according to the present invention.

In the embodiment of FIG. 4, the cylinders 5 realize both the advancement of the shield 1, and the variation of the direction of the structure shield 1/shield 3 with respect to the shield 2, as they are arranged between the support 6 of the head 15 and the shield 2 itself.

The present invention has been disclosed with specific reference to preferred embodiments thereof, but it is to be understood that variations and/or modifications can be made by those who are skilled in the art, without so departing from the scope of protection defined by the appended claims.

I claim:

1. A boring machine for digging tunnels, commonly called a double shield boring machine, of the type comprising a first, front shield, containing the boring head and its driving members, and a second shield, fitted with pads or "grippers" for providing the anchorage necessary for the advancement of the boring machine, characterized in that a third shield is provided, arranged between said first and said second shield such that the first shield overlaps partially to it and is able to slide axially with respect to the third shield itself, and that the assembly first shield/third shield can vary its advancement direction with respect to the second shield; guide means being provided between said first shield and said third shield, that allow these latter to perform a relative motion in the longitudinal axial direction only, keeping concentric, and prevent relative rotations about the longitudinal axis, means being provided for advancing said first shield with respect to said third shield, as well as means for setting at an angle the assembly first shield/third shield with respect to said second shield.

2. A boring machine according to claim 1, characterized in that said guide means between said first and second shield are made up of a longitudinal axial central structure, integral with the first shield, sliding within a guide arranged on said third shield.

3. A boring machine according to claim 2, in which said central structure is a tubular structure.

4. A boring machine according to claim 2 or 3, characterized in that the coupling between the central structure and the guide extends longitudinally so as to support radial, twisting and bending loads.

5. A boring machine according to claim 2 or 3, characterized in that the coupling between the central structure and the guide is longitudinally extended, so as to support the radial loads and the bending and twisting moments, further lateral guide means being provided between the first and the third shield.

6. A boring machine according to claim 5, in which said further guide means are comprised of beams peripherally supported by said first shield and by corresponding peripheral guides supported by the third shield.

7. A boring machine according to claim 1, characterized in that the partial overlap between the first and the third shield is realized in the proximity of the zone of the coupling between the second and the third shield.

8. A boring machine according to claim 1, characterized in that the partial overlap between the first and the third shield is realized in an opposite position with respect to coupling zone between the second and the third shield.

9. A boring machine according to claim 1, characterized in that said first shield is arranged in correspondence with the zone of the overlap with the third shield, completely external to the third shield itself.

10. A boring machine according to claim 1, characterized in that the means for advancing the first shield with respect to the third shield are comprised of first hydraulic cylinders, identical to each other, fed in parallel, arranged between the first and the third shield, and the means for setting at an angle the assembly first shield/third shield with respect to the second shield are made up of second variable flow hydraulic cylinders arranged between the second and the third shield.

11. A boring machine according to claim 1, characterized in that the means for advancing the first shield with respect to the third shield and the means for setting at an angle the assembly first shield/third shield with respect to the second shield are made up of variable flow; hydraulic cylinders, identical to each other, arranged between the first and the second shield.

12. A boring machine according to claim 1, characterized in that third hydraulic cylinders, tangential in the plane perpendicular to the longitudinal axis of the shields which control the rotations of the assembly first/third shield with respect to the second shield are provided between the second and the third shield.

13. A boring machine according to claim 1, characterized in that the outer portion of the first shield and/or the outer portion of the third shield are comprised of detachable sectors.

14. A boring machine according to claim 1, characterized in that seal and/or cleaning members are provided in the telescopic zone.

15. A boring machine according to claim 1, characterized in that the trailing edge of the third shield and the leading edge of the second shield are shaped to provide an articulated interlocking relationship.

* * * * *